United States Patent [19]

Ando et al.

[11] 4,231,276

[45] Nov. 4, 1980

[54] ELECTRONIC MUSICAL INSTRUMENT OF WAVESHAPE MEMORY TYPE

[75] Inventors: Shigeo Ando, Iwata; Takayasu Kondou, Hamamatsu, both of Japan

[73] Assignee: Nippon Gakki Seizo Kabushiki Kaisha, Hamamatsu, Japan

[21] Appl. No.: 938,255

[22] Filed: Aug. 30, 1978

[30] Foreign Application Priority Data

Sep. 5, 1977 [JP] Japan ..... 52-105792

[51] Int. Cl.[3] ..... G10H 1/02

[52] U.S. Cl. ..... 84/1.19; 84/1.24; 84/1.26

[58] Field of Search ..... 84/1.01, 1.03, 1.19, 84/1.21, 1.22, 1.24, 1.26, 1.27, DIG. 7

[56] References Cited

U.S. PATENT DOCUMENTS

| | | | |
|---|---|---|---|
| 3,767,833 | 10/1973 | Noble | 84/1.19 |
| 3,819,843 | 6/1974 | Okamoto | 84/1.27 |
| 3,935,783 | 2/1976 | Machanian | 84/1.21 |
| 4,033,219 | 7/1977 | Deutsch | 84/1.26 |
| 4,077,294 | 3/1978 | Hiyoshi | 84/1.24 |
| 4,079,651 | 3/1978 | Matsui | 84/DIG. 7 |
| 4,111,092 | 9/1978 | Adachi | 84/1.27 |
| 4,141,269 | 2/1979 | Itakura | 84/1.27 |

*Primary Examiner*—J. V. Truhe
*Assistant Examiner*—William L. Feeney
*Attorney, Agent, or Firm*—Cushman, Darby & Cushman

[57] ABSTRACT

In an electronic musical instrument of a keyboard type wherein waveshapes with different tone colors read out from waveshape memories are mixed together at a mixing ratio according to a control signal and the resultant signal is converted to a corresponding musical tone, the control signal is varied with lapse of time and also is controllable in response to the initial speed at which a key of the keyboard is depressed and to the strength of pressure of the key being depressed, in addition to time lapse. Thus, the pattern of tone variation can be variously controlled.

14 Claims, 6 Drawing Figures

ELECTRONIC MUSICAL INSTRUMENT OF WAVESHAPE MEMORY TYPE

BACKGROUND OF THE INVENTION (a) Field of the Invention

The present invention is related to a keyboard style electronic musical instrument of the waveshape memory type wherein different waveshapes read out from the memories are mixed together at a certain mixing ratio and then converted to musical sounds. More particularly, the present invention pertains to an improved electronic musical instrument of the type mentioned above, wherein the waveshape mixing ratio is variable through the touch control of the key operation done by the player of the instrument.

(b) Description of the Prior Art

In U.S. patent application Ser. No. 773,788 filed on Mar. 2, 1977 by the same assignee as that of the present application, there is proposed a keyboard style electronic musical instrument of the waveshape memory type wherein a plurality of different waveshapes are read out from a plurality of memories and then mixed together at a mixing ratio which is variable either with lapse of time or in accordance with the nature of the touch of the key depressed by the player of the instrument.

Another musical instrument of the waveshape memory type has been proposed in U.S. patent application Ser. No. 898,523 filed on Apr. 20, 1978, by the same inventors as those of the present application. In the musical instrument disclosed in this earlier application, mixing of the waveshapes read out from waveshape memories is adapted to be performed by carrying out multiplications individually for the respective retrieved waveshapes with associated time-dependent parameters and then by adding up the resultant values to obtain the aimed musical sounds.

Since, in the electronic musical instrument which was priorly proposed by the same inventors, read-only memories are read out by a constant read-out address signal, once the parameter signals which are to be memorized in these read-only memories have been determined, there will be developed variation of tone of the musical sound produced (variation of the configuration of the musical tone waveshape) always in a same pattern. Accordingly, it is not possible to control the pattern of tone variation of the musical sound produced in accordance with the nature of the touch of a finger of the player onto a key of the keyboard as is possible in a natural musical instrument.

SUMMARY OF THE INVENTION

A primary object of the present invention, therefore, is to provide an improved keyboard style electronic musical instrument of the waveshape memory type, which is capable of producing such musical tones as are variable in tone color in accordance with lapse of time and also with the nature of the touch of a key in the keyboard, i.e. the duration of the key depression, the depression speed of a key and the depression pressure on the key.

Another object of the present invention is to provide an electronic musical instrument of the type described above, which permits the instrument player to control, at his own will, the tone color of the musical tones being produced in a variety of ways, through touch control of key operation.

A further object of the present invention is to provide a realizable and practical arrangement of means for varying the tone color of the musical sound pronounced by the electronic musical instrument of the type described above.

According to the present invention, there is provided a keyboard style electronic musical instrument comprising: a plurality of waveshape memories storing waveshapes of different tone colors; means responsive to the operation of individual keys in the keyboard for addressing the waveshape memories to read out waveshape from the waveshape memories at a repetition rate corresponding to a depressed key of the keyboard; mixing means for mixing the derived waveshapes at a mixing rate according to a signal from mixing rate control means; means for converting the output of this mixing means to a corresponding musical tone; means responsive to the operation of each key for generating a touch-responsive signal related to the initial speed of depression of the key of the keyboard and the strength of pressure with which the key is depressed; means responsive to the operation of the key for generating a time-dependent signal which changes with time after the depression of the key; and means for producing the above-mentioned mixing ratio control signal based on both the touch-responsive signals and the time-dependent signal.

These and other objects, the features and the advantages of the present invention will become apparent by reading the following detailed description of the preferred embodiment of the invention when taken in conjunction with the accompanying drawings.

DETAILED DESCRIPTION OF THE PREFERRED EMBODIMENT

Figure 1:
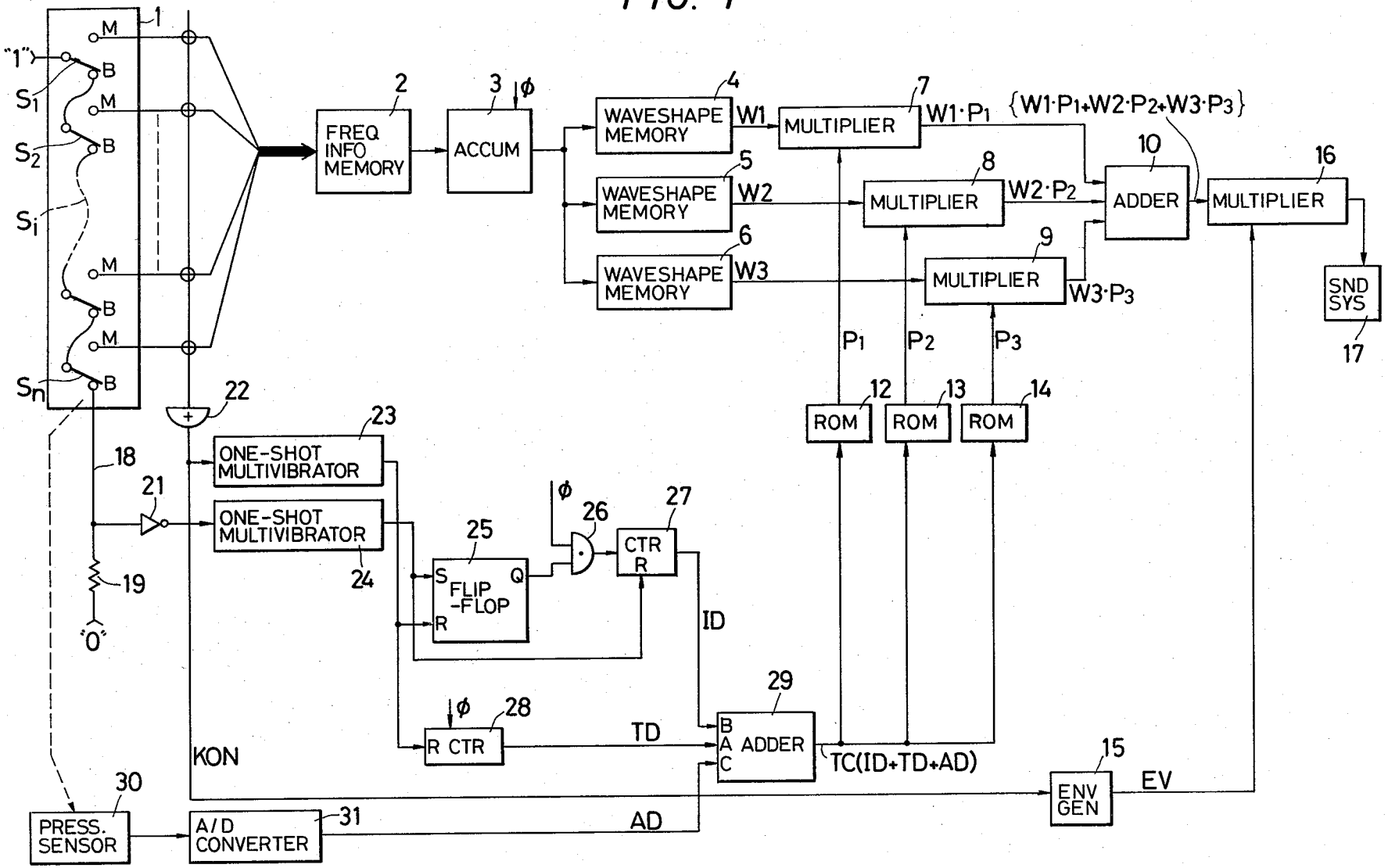
FIG. 1 is a block diagram of an embodiment of the keyboard style electronic musical instrument according to the present invention.

An embodiment of the keyboard style electronic musical instrument according to the present invention is shown in FIG. 1 in block form.

In this figure, a keyboard circuit 1 is provided for selecting a musical tone to be produced in response to the depression of a key of a keyboard (not shown) of the instrument. The keyboard circuit 1 is composed of key switches $S_1$–$S_n$ which are ganged, respectively, with corresponding keys in the keyboard. The break contacts B of the resective key switches $S_1$–$S_{n-1}$ are wired to movable contacts of the neighboring key switches $S_2$–$S_n$. The movable contact of the key switch $S_1$ is held at a logical "1" potential, and the break contact of the key switch $S_n$ is connected via a resistor 19 to a logical "0" potential. The make contacts of the respective key switches $S_1$–$S_n$ are fed to the address input of a frequency information memory 2. When none of the keys in the keyboard is depressed, the movable contacts of all the key switches $S_1$–$S_n$ are positioned, as shown, at the break contacts thereof. When a key which is numbered for example "i" (not shown) in the keyboard is depressed, the movable contact of a corresponding key switch $S_i$ is caused to move to its make contact, so that a logical "1" potential appears only at this make contact. It should be noted here that the keyboard circuit 1 is designed to operate so that, when a plurality of keys are depressed at a time, it selects one key assigned with a smaller key-number, in preference to others, among those depressed keys, and thus a single key is specified for evaluation.

The potential pattern on the respective make contacts of the keyboard circuit 1 is used for addressing the frequency information memory 2 in which has been stored the frequency information corresponding to each key of the keyboard. Thus, when a key is depressed and selected in the keyboard circuit 1, the frequency information memory 2 is accessed with an address given by the potential pattern on the set of make contacts of the circuit 1, thereby a frequency information corresponding to the selected key is delivered. The frequency information which has been read out is successively added, at each arrival of a clock pulse $\phi$, to the content in an accumulator 3 with a modulus. The temporary content of the accumulator 3 is successively transferred to the address inputs of waveshape memories 4, 5 and 6.

Figure 2A:
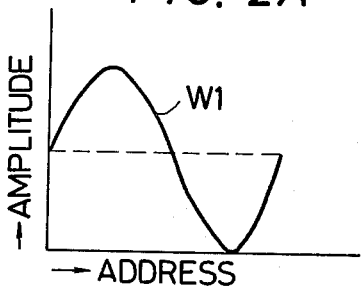
FIGS. 2A, 2B and 2C are charts illustrating an example of a set of waveshapes stored in respective waveshape memories shown in FIG. 1.
Figure 2B:
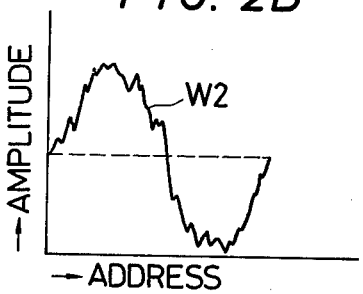
Figure 2C:
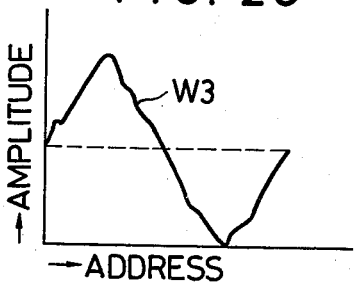

In the waveshape memories 4, 5 and 6, there have been previously stored different waveshapes with different tone colors, respectively. These waveshapes may preferably be stored in digital representation. More particularly, the amplitudes for sample points of the respective waveshapes may be stored in individual address locations of the waveshape memories 4, 5 and 6. An example of the set of the waveshapes stored in the waveshape memories 4, 5 and 6 is shown in FIGS. 2A, 2B and 2C as amplitude versus address. The waveshape $W_1$ of FIG. 2A, which is stored in the memory 4, is a pure sinusoidal waveshape containing no higher harmonics. The waveshape $W_2$ of FIG. 2B, which is stored in the memory 5, is a heavily-distorted sinusoidal waveshape with a large amount of higher harmonics included. The waveshape $W_3$, which is stored in the memory 6, is a fairly-deformed sinusoidal waveshape containing a fairly little amount of higher harmonics. However, all the waveshapes $W_1$, $W_2$ and $W_3$ have the same fundamental frequency. It is to be noted that each waveshape memory may store only a fourth part of a complete cycle of each waveshape, i.e. absolute amplitudes at sample points in a partial waveshape extending from the zero level to the peak level, which are read four times to retrieve one complete cycle of the waveshape. This is effective in reducing the memory capacity.

Referring again to FIG. 1, as a key is depressed, the waveshape memories 4, 5 and 6 are successively addressed with the content of the accumulator 3 in synchronism with the clock pulse $\phi$ timing. Thus, there will be retrieved from the waveshape memories 4, 5 and 6 different waveshapes $W_1$, $W_2$ and $W_3$ at a repetition rate, that is, a fundamental frequency corresponding to the depressed key.

The waveshapes $W_1$, $W_2$ and $W_3$ which have been read out from the waveshape memories 4, 5 and 6 are fed to a variable mixing circuit. The mixing circuit consists of multipliers 7, 8 and 9, an adder 10, and read-only memories 12, 13 and 14. The memories 12, 13 and 14 contain variable parameters $P_1$, $P_2$ and $P_3$. The memories 12, 13 and 14 are addressed with a mixing rate control signal TC, and the parameters $P_1$, $P_2$ and $P_3$ are read out from the memories 12, 13 and 14. The derived waveshapes $W_1$, $W_2$ and $W_3$ are multiplied, at the multipliers 7, 8 and 9, by the associated parameters $P_1$, $P_2$ and $P_3$ which are read out. The multiplied waveshapes are then added up at the adder 10. As such, there is accomplished the mixing of the waveshapes which are read out and have different tone colors at a mixing ratio dependent on the mixing rate control signal TC.

Figure 3:
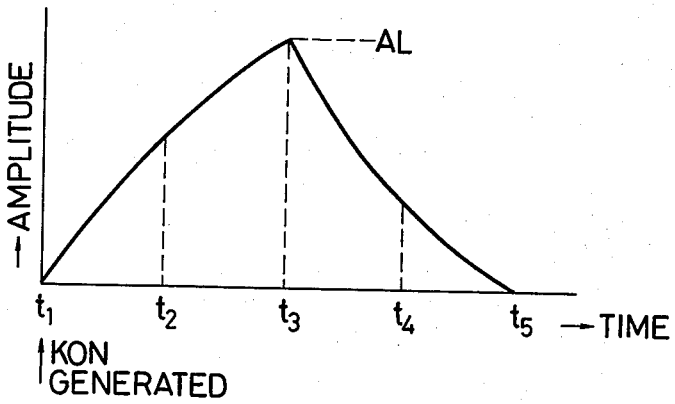
FIG. 3 is a chart illustrating a typical example of an envelope shape generated by an envelope generator in FIG. 1.

The mixed waveshape, which is delivered from the adder 10, is supplied to a multiplier 16. The multiplier 16 is provided for imparting, to the mixed waveshape, an envelope characteristic according to an envelope shape EV generated from an envelope generator 15. The generator 15 is designed to operate so that when initiated with a key-on signal KON upon the depression of a key, it starts generation of the envelope shape EV. The signal KON is an output signal of an OR circuit 22 which takes the logical OR of the potentials on the respective make contacts M. The envelope shape may be usually classified into two types: a known percussive shape as shown in FIG. 3, and a known sustain shape (not shown). The envelope generator preferably is designed so that either one of these two types of envelope shapes can be selected by means of a musical tone color selection switch provided on the panel board of the instrument. The waveshape supplied from the adder 10 is multiplied, at the multiplier, with the envelope shape EV generated at the generator 15, thus being imparted with an envelope characteristic. The envelope-imparted waveshape, in turn, is fed to a sound system 17 where it is converted to a corresponding musical tone. The sound system 17 essentially comprises an audio amplifer and a loud speaker, and may also include a digital-analog converter if the waveshapes $W_1$, $W_2$ and $W_3$ are stored in the memories 4, 5 and 6 in digital representation, respectively.

The afore-mentioned mixing ratio control signal TC is supplied by circuit means which includes an inverter 21, one-shot multivibrators 23 and 24, a flip-flop 25, and AND gate 26, counters 27 and 28, a pressure sensor 30, an analog-to-digital converter 31, and an adder 29. The one-shot multivibrator 23 is triggered with the key-on signal KON and then it delivers out one pulse with which both the counter 28 and the flip-flop 25 are re-set. The potential on the line 18 between the contact B of the key switch $S_n$ and the resistor 19 is inverted by the inverter 21, and the positive transition of whose output triggers the one-shot multivibrator 24. The output pulse of the one-shot multivibrator 24 is supplied to re-set the counter 27 and also to set the flip-flop 25. The output of the flip-flop in the set state enables the AND gate to supply therethrough the clock pulse $\phi$ to the counter 27 for incrementing or decrementing the content in the counter 27. The pressure sensor 30 is provided for detecting the pressure applied onto a key which is depressed in the keyboard and for generating an output signal in proportion to the pressure strength detected. The output signal of the sensor 30, which is an analog signal, is converted to an equivalent signal AD in digital representation. The outputs ID and TD of the counters 27 and 28 and the output AD are added up at the adder 29 to produce the mixing rate control signal TC. As the pressure sensor 30, there can be used a known pressure-sensitive device such as those wherein conductive rubber or piezoelectric material is used for converting the pressure applied thereto by the key to a corresponding electrical signal. An example of such a pressure sensor is disclosed in U.S. Pat. No. 4,079,651.

Operation of the signal TC generating circuit means will be explained hereinbelow.

Upon depression of a key of the keyboard, the movable contact of a corresponding key switch $S_i$ is immediately released from its break contact B, and then is transferred to its make contact M at a transition speed according to the initial depression speed of the key. The removal of the movable contact $S_i$ from the break contact prevents the supply of the logical "1" potential to the line 18, thus lowering the line 18 potential to the logical "0" potential. Therefore, the output of the inverter 21 changes to the logical "1" potential, and triggers the one-shot multivibrator 24. By the leading edge of a pulse outputted form the triggered one-shot multivibrator 24, the counter 27 is re-set and the flip-flop 25 is set. The Q output of the flip-flop 25 in the set condition supplies the logical "1" potential which enables the gate 26 to supply the clock pulse $\phi$ to the counter 27. The gated clock pulses $\phi$ are counted in the counter 27. The clock pulse counting in the counter 27 continues until the movable contact $S_i$ reaches the make contact M thereof, as will be explained below.

At the moment that the movable contact $S_i$ has reached the make contact M thereof, the logical "1" potential appears at this make contact, thus establishing the key selection. Simultaniously, there is started generation of waveshape from the waveshape memories 4, 5 and 6. The logical "1" potential at the make contact of the operated key-switch $S_i$ is outputed through the OR gate 22, as a key-on signal KON, which output triggers the one-shot multivibrator 23 and also initiates the envelope generator 15. Upon being thus triggered, the multivibrator 23 delivers a pulse which, in turn, re-sets at its leading edge both the flip-flop 25 and the counter 28. When re-set, the flip-flop 25 is actuated so that its Q output is returned to the logical "0" potential, so that AND gate 25 inhibits the clock pulse from being supplied therethrough to the counter 27. Accordingly, the counter 27 stops counting of the clock pulse $\phi$. At this moment, therefore, the content in the counter 27 represents the number of the clock pulses $\phi$ generated during the period that the travel of the movable contact $S_i$ from the break contact to the make contact is completed. In other words, there is obtained and held in the counter 27 a count ID which is inversely proportional to the initial speed of the key depression (initial touch). On the other hand, the counter 28 which has been re-set with the output of the one-shot 23 re-starts counting of the clock pulse $\phi$. The content TD in the counter 28 increments at each arrival of clock pulse $\phi$, thus designating the time lapse after the generation of the key-on signal KON. With respect to the pressure sensor 30, when the key is depressed, i.e. the key-on signal is generated, it delivers out an analog signal corresponding to the strength of pressure with which the key is depressed (after-touch). The output signal of the pressure sensor 30 is converted by the analog-to-digital converter 31 to a corresponding digital signal AD.

The outputs ID, TD and AD of the means 27, 28 and 31 are added up by the adder 29 to produce a mixing ratio control signal TC which is used as an address input signal for the parameter read-only memories 12, 13 and 14.

With the instrument described above, it is possible to produce a musical tone whose tone color varies with respect to lapse of time, and also in accordance with the nature of the touch of key being depressed, as will be explained further in detail hereunder by referring to FIGS. 3 and 4.

At the moment $t_1$ (see FIG. 3) when a make contact which is associated with a depressed key is closed and when thus the key-on signal KON is generated, the control signal TC includes only the output ID of the counter 27 which corresponds to the initial depression speed of the key, because the outputs TD and AD at such time still remain zero. Thus, at this moment, the read-only memories 12, 13 and 14 are accessed with an address specified by the counter 27 output ID. Thereafter, the output TD of the counter 28 continues incrementing with lapse of time, and the output AD of the converter 31 attains a value corresponding to the strength of pressure with which the key is depressed. Therefore, the value of the signal TC, i.e. the memory accessing address, is incremented, from the initial address specified by the initial speed of key depression, with lapse of time at a rate which is dependent on the frequency of the clock pulse $\phi$ and also on the strength of the key depression.

Figure 4:
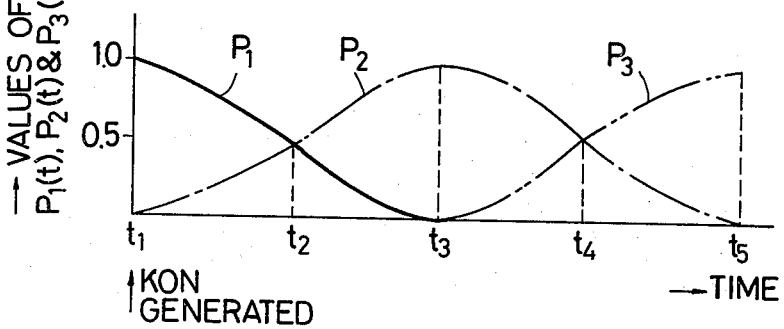
FIG. 4 is a chart showing an example of a set of parameters read out from respective read-only memories in FIG. 1.

FIG. 4 shows an example of the set of parameters $P_1$, $P_2$ and $P_3$ read out from the read-only memories 12, 13 and 14 in accordance with the address signal TC which always varies due to the time-variable signal TD. As seen from the FIG. 4, the respective parameters are different in value versus address characteristic. In this example, there is produced a musical tone which varies in tone color in such a manner as will be stated below. At the moment $t_1$ when the key-on signal KON is generated, there are read out from the read-only memories 12, 13 and 14, the parameters $P_1=1$, $P_2=0$ and $P_3=0$, hence the output of the adder 10 contains only the component of the waveshape $W_1$. Therefore, the produced musical tone, in the early period of generation thereof, has a simple tone color with hardly any amount of higher harmonic components. At the moment $t_2$ when the envelope shape EV shown in FIG. 3 attains one half of a highest value AL, the parameters $P_1=0.5$, $P_2=0.5$ and $P_3=0$ are read out from the read-only memories 12, 13 and 14. Hence, the output waveshape of the adder 10 contains two kinds of waveshapes $W_1$ and $W_2$ mixed at a ratio of 1:1, so that a musical tone assorted with a relatively large amount of higher harmonic components is produced by the instrument. At the moment $t_3$ when the envelope shape EV attains the highest value AL and when the produced tone attains a peak intensity, the parameter $P_1$ decreases to zero (0) while the parameter $P_2$ increases up to one (1). Accordingly, only the component of the waveshape $W_2$ is delivered out from the adder 10, and thus a colorful tone containing a large amount of higher harmonic components is produced. Thereafter, the parameter $P_2$ gradually decreases with time while the parameter $P_3$ gradually increases. At the moment $t_4$ when the envelope shape EV decreases, to below one half of the highest value AL, both the parameters $P_2$ and $P_3$ attain 0.5, and the output waveshape of the adder 10 contains the components of the two waveshapes $W_2$ and $W_3$ mixed at a ratio of 1:1. Thus, there is produced a musical tone containing a fairly large amount of higher harmonic components. At the moment $t_5$, the parameter $P_2$ diminishes to zero (0) while the parameter $P_3$ reaches one (1). Then, only the component of the waveshape $W_3$ is delivered from the adder 10, with the result that there is produced a relatively simple tone containing a relatively small amount of higher harmonic components.

It should be noted, here, that the manner in which the tone color of produced musical tone changes with time can be altered through touch control of the key depression. For instance, if a key is depressed at a lower speed, the output ID of the counter 27 becomes larger than that in the aforementioned case. This will lead to different values of the parameters $P_1$, $P_2$ and $P_3$ which are read out from the read-only memories 12, 13 and 14 at the moment $t_1$ when the key-on signal KON is generated, so that the manner of tone color variation is changed in response to the initial depression speed of the key. Similarly, a change in the depression strength with which the key is depressed will apparently cause corresponding changes in the values of the parameters $P_1$, $P_2$ and $P_3$ which are read out from the read-only memories 12, 13 and 14. Any succeeding change in the key depression pressure after the key is once depressed also causes corresponding tone color variation after the rise of a sound.

As described above, with the improved electronic musical instrument of the present invention, it is possible to produce a musical tone whose tone color varies with time, and further it is possible to widely alter the manner of variation of the tone color of a tone being produced, in accordance with the nature of the touch of the key including the initial depression speed of the key and the strength of this key depression.

Additionally speaking, in the above-described embodiment according to the present invention, the counter 27 may be arranged to count down the clock pulse $\phi$, and the read-only memories 12, 13 and 14 for delivering the parameters $P_1$, $P_2$ and $P_3$ may be replaced by any known function generator that can generate similar parameters in response to the mixing ratio control signal TC. Moreover, there may be changed the manner in which the values of the parameters $P_1$, $P_2$ and $P_3$ vary in accordance with said control signal TC. Furthermore, it may be possible to change the number of the waveshape memories and the form of the stored waveshapes in the waveshape memories.

What is claimed is:

1. A keyboard style electronic musical instrument comprising:

a plurality of waveshape storage means storing waveshapes with different tone colors, said waveshapes being same in fundamental frequency but different from each other in amount of harmonics;

addressing means responsive to the operation of a key of the keyboard for addressing said waveshape storage means to read out said waveshapes from the waveshape storage means at a repetition rate corresponding to a depressed key of the keyboard;

mixing means for mixing the waveshapes read out from said waveshape storage means, at a mixing ratio according to a mixing ratio control signal;

conversion means for converting the output of said mixing means to a corresponding musical tone;

touch-responsive means responsive to the operation of the key of said keyboard for generating a first touch-responsive signal corresponding to the initial speed at which the key of said keyboard is depressed, and a second touch-responsive signal corresponding to the strength of pressure with which the key is depressed;

generating means responsive to the operation of the key of said keyboard for generating a time-dependent signal changing with time after the key depression; and producing means for producing said mixing ratio control signal on the basis of said first and second touch-responsive signals and said time-dependent signal.

2. An electronic musical instrument according to claim 1, in which: said touch-responsive means and said generating means comprise in association a first and second counter for counting a clock pulse, a control circuit for controlling the first and second counters in such a manner that the first counter counts said clock pulse for a time period corresponding to the initial speed of the key depression while the second counter starts counting of the clock pulse upon the key depression, and a pressure-sensitive sensor for sensing the pressure applied to the depressed key and thereby delivering, as said second touch-responsive signal, a signal corresponding to the strength of the sensed pressure, said first and second counters delivering said first touch-responsive signal and said time-dependent signal, respectively.

3. An electronic musical instrument according to claim 2, in which: said producing means comprises an adder for adding up said first and second touch-responsive signals and said time-dependent signal and thereby for producing the resultant signal as said mixing ratio control signal.

4. An electronic musical instrument according to claim 2, in which: said addressing means includes a plurality of key switches each being ganged with a corresponding key of said keyboard, the key switches each having a movable contact which is moved jointly with the corresponding key, a first stationary contact on which the movable contact is positioned when the corresponding key is not depressed, and a second stationary contact on which the movable contact is positioned while the corresponding key is depressed, and in which: said control circuit includes first circuit means for detecting disconnection between the movable and first stationary contacts of the key switch ganged with the operated key to thereby re-set said first counter and to cause the first counter to start counting of said clock pulse, and second circuit means for detecting connection between the movable and second stationary contacts of said key switch ganged with the operated key to thereby re-set said second counter and to cause said first counter to stop counting of the clock pulse.

5. An electronic musical instrument according to claim 2, in which: said signal delivered from said pressure-sensitive sensor is converted to a corresponding digital signal by a converter and then fed to said producing means.

6. An electronic musical instrument according to claim 4, in which: said first circuit means includes a flip-flop, a first one-shot multivibrator for triggering the flip-flop into its set state and re-setting said first counter, and a gate enabled by an output of the flip-flop in the set to supply therethrough the clock pulse to said first counter, and in which: said second circuit means includes said flip-flop, and a second one-shot multivibrator for triggering the flip-flop into its re-set state and resetting said second counter.

7. An electronic musical instrument according to claim 1, in which: said mixing means includes parameter generating means for generating parameters according to said mixing ratio control signal, and a plurality of multipliers for multiplying the waveshapes read out from said waveshape storage means with associated parameters generated from the parameter generating means, and an adder for adding up the output signals of the multipliers to obtain said output of the mixing means.

8. An electronic musical instrument according to claim 7, in which: said parameter generating means comprises a plurality of storage means for storing said parameters and being accessible with an address specified by said mixing control signal to deliver the parameters.

9. An electronic musical instrument according to claim 4, in which: said addressing means further comprises means responsive to the operation of said key switch for supplying information representative of the depressed key of said keyboard, and means for cumulatively adding said information at each arrival of a clock pulse, and in which: said waveshape storage means are repetitively accessed with addresses designated by the outputs of the cumulatively adding means.

10. In a keyboard type electronic musical instrument including a keyboard having a plurality of keys; a plurality of waveshape storage means for obtaining a plurality of waveshape component signals having different harmonic content; means for combining said waveshape component signals in a ratio determined by a plurality of mixing parameters, each of said mixing parameters being associated with a predetermined one of said waveshape component signals; and means for obtaining sound from the output of said means for combining the waveshape component signals; the improvement comprising:

first information means for generating a depression-speed signal indicative of the speed at which a selected one of said keys is depressed;

second information means for generating a time-lapse signal indicative of a period during which said selected one of the keys is depressed;

third information means for generating an applied-pressure signal indicative of the pressure with which said selected one of the keys is depressed; and means responsive to said depression-speed signal, said time-lapse signal, and said applied-pressure signal for providing said plurality of mixing parameters.

11. The keyboard type electronic musical instrument as in claim 10 wherein said first information means is in combination with said second information means, said combination comprising:

a first counter;

a second counter; and enabling means effective to enable said first counter to respond to a timing signal for a period determined by the speed at which said selected one of the keys is depressed for counting pulses, and to enable said second counter to respond to said timing signal for the period during which said selected one of the keys is depressed for counting pulses.

12. The keyboard type electronic musical instrument as in claim 11 wherein said enabling means comprises:

a plurality of normally-close contacts connected in series, each of said normally-close contacts associated with a predetermined one of said keys;

a plurality of normally-open contacts, each of said normally-open contacts associated with a predetermined one of said keys;

means for obtaining the logical OR of said plurality of normally-open contacts;

a first multivibrator responsive to the output of said plurality of normally-close contacts;

a second multivibrator responsive to the output of said means for obtaining the logical OR;

a flip-flop set by the output of said first multivibrator and reset by the output of said second multivibrator; and a gate responsive to the output of said flip-flop; wherein said first counter is reset by the output of said first multivibrator and thereafter responsive to said timing signal, said timing signal being applied to said first counter through said gate during an interval of time determined from the opening of one of said normally-close contacts to the closing of an associated one of said normally-open contacts, whereby said first counter contains a first value indicative of the speed at which said selected one of the keys is depressed; and wherein said second counter is reset by the output of said second multivibrator and thereafter responsive to said timing signal, whereby said second counter contains a second value indicative of a lapse of time since said selected one of the keys was depressed.

13. The keyboard type electronic musical instrument as in claim 10 wherein said third information means comprises:

a pressure-sensitive sensor, and converting means responsive to the output of said pressure-sensitive sensor for obtaining said applied-pressure signal.

14. The keyboard type electronic musical instrument as in claim 10 wherein said means for providing the plurality of mixing parameters comprises:

a first adder responsive to said depression-speed signal, said time-lapse signal, and said applied-pressure signal for generating a mixer address signal; and a plurality of mixer parameter storage means responsive to said mixer address signal for providing a plurality of mixing parameters, each of said mixing parameters being associated with a predetermined one of said mixer parameter storage means;

and wherein said means for combining the waveshape component signals comprises:

a plurality of multipliers, each of said multipliers being associated with a predetermined one of said waveshape component signals and a predetermined one of said mixing parameters; and a second adder responsive to outputs of said multipliers.

* * * * *